US010948846B1

(12) United States Patent
Iguchi

(10) Patent No.: US 10,948,846 B1
(45) Date of Patent: Mar. 16, 2021

(54) IMAGE FORMING APPARATUS AND METHOD OF CONTROLLING IMAGE FORMING APPARATUS

(71) Applicant: TOSHIBA TEC KABUSHIKI KAISHA, Tokyo (JP)

(72) Inventor: Ken Iguchi, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/820,757

(22) Filed: Mar. 17, 2020

(51) Int. Cl.
*G03G 15/00* (2006.01)
*G03G 15/08* (2006.01)

(52) U.S. Cl.
CPC ..... *G03G 15/0856* (2013.01); *G03G 15/556* (2013.01)

(58) Field of Classification Search
CPC ..... G03G 15/0856; G03G 15/553; G03G 15/556; G03G 2215/0888
See application file for complete search history.

(56) References Cited

U.S. PATENT DOCUMENTS

2007/0154242 A1* 7/2007 Matsumoto ..... G03G 15/0849 399/254
2008/0304838 A1* 12/2008 Suenaga ..... G03G 15/0856 399/27
2009/0034995 A1* 2/2009 Mochizuki ..... G03G 21/1889 399/27
2011/0255888 A1* 10/2011 Itoyama ..... G03G 15/553 399/30
2011/0318024 A1* 12/2011 Kawaguchi ..... G03G 15/0856 399/27
2012/0250097 A1* 10/2012 Tanaka ..... H04N 1/60 358/3.24
2015/0355573 A1* 12/2015 Jeong ..... G03G 15/0856 399/58
2019/0072890 A1* 3/2019 Maeda ..... G03G 15/556
2019/0286039 A1* 9/2019 Ajima ..... G03G 15/556
2020/0201230 A1* 6/2020 Ohta ..... G03G 15/556

FOREIGN PATENT DOCUMENTS

JP 11-174909 7/1999

* cited by examiner

*Primary Examiner* — Sophia S Chen
(74) *Attorney, Agent, or Firm* — Amin, Turocy & Watson, LLP

(57) ABSTRACT

According to one embodiment, an image forming apparatus includes a photosensitive drum, an exposure unit, a development unit, a toner supply motor, and a processor. The exposure unit exposes the photosensitive drum based on image data. The development unit forms a toner image on the photosensitive drum with toner supplied from a toner cartridge. The toner supply motor supplies the toner to the development unit from the toner cartridge. The processor calculates a remaining toner amount in the toner cartridge based on a preset standard supply ratio, a driving time of the toner supply motor, and a toner supply ratio which is calculated based on a pixel count value of the image data and the driving time of the toner supply motor.

20 Claims, 5 Drawing Sheets

IMAGE FORMING APPARATUS AND METHOD OF CONTROLLING IMAGE FORMING APPARATUS

FIELD

Embodiments described herein relate generally to an image forming apparatus and a method of controlling an image forming apparatus.

BACKGROUND

Image forming apparatuses receive toner from toner cartridges and perform image forming processes of forming toner images on photosensitive drums. The image forming apparatuses transfer the toner images on the photosensitive drums on print media.

In an image forming apparatus, a remaining toner amount in a toner cartridge is calculated based on a driving amount (a driving time) of a motor (a toner supply motor) that rotates a screw sending toner from the toner cartridge to the image forming apparatus or a pixel amount (a pixel count value) of print image data.

There are individual differences between the bodies of image forming apparatuses and toner cartridges. A variation in a toner supply amount per driving time occurs due to such individual differences. The variation caused by the individual differences between the image forming apparatuses can be corrected in accordance with a preset "correction amount." However, in order to correct the variation caused by an individual difference between the toner cartridges, there is a problem that it is necessary to have a "correction amount" for each toner cartridge.

DETAILED DESCRIPTION

In general, according to one exemplary embodiment, there is provided an image forming apparatus including a photosensitive drum, an exposure unit, a development unit, a toner supply motor, and a processor. The exposure unit exposes the photosensitive drum based on image data. The development unit forms a toner image on the photosensitive drum with toner supplied from a toner cartridge. The toner supply motor supplies the toner to the development unit from the toner cartridge. The processor calculates a remaining toner amount in the toner cartridge based on a preset standard supply ratio, a driving time of the toner supply motor, and a toner supply ratio which is calculated based on a pixel count value of the image data and the driving time of the toner supply motor.

Hereinafter, an image forming apparatus and a method of controlling an image forming apparatus according to an embodiment will be described with reference to the drawings.

Figure 1:
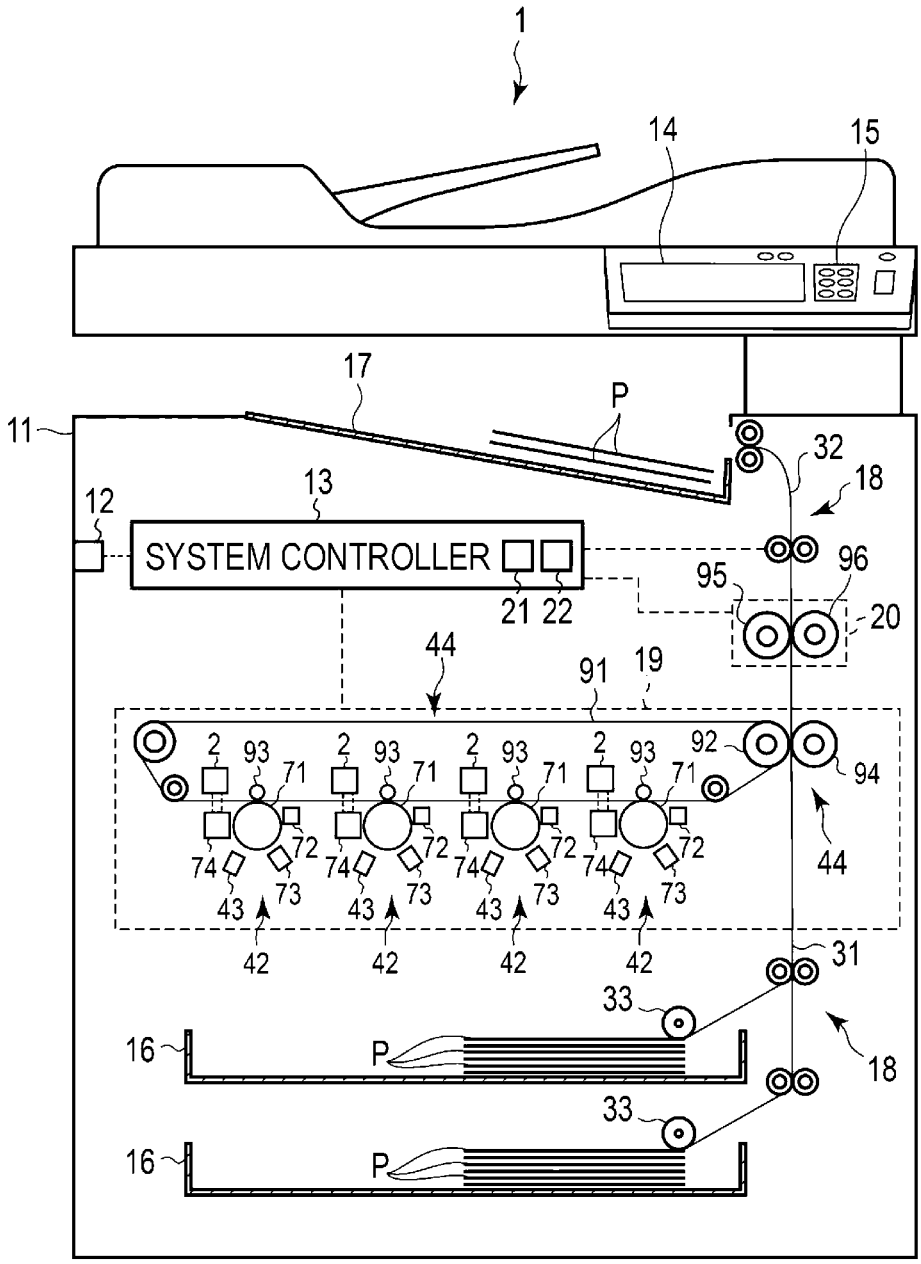
FIG. 1 is a diagram illustrating a configuration example of an image forming apparatus according to an embodiment.

FIG. 1 is a diagram illustrating a configuration example of an image forming apparatus 1 according to the embodiment.

The image forming apparatus 1 is, for example, a multifunction printer (MFP) that performs various processes such as image forming while conveying a recording medium such as a printing medium. The image forming apparatus 1 is, for example, a solid-state scanning type printer (for example, an LED printer) that scans an LED array performing various processes such as image forming while conveying a recording medium such as a printing medium.

For example, the image forming apparatus 1 has a configuration in which toner is received from a toner cartridge 2 and an image is formed on a printing medium using the received toner. The toner may be monochromic toner or may be color toner of, for example, cyan, magenta, yellow, and black.

As illustrated in FIG. 1, the image forming apparatus 1 includes a casing 11, a communication interface 12, a system controller 13, a display unit 14, an operation interface 15, a plurality of sheet trays 16, a discharge tray 17, a conveyance unit 18, an image forming unit 19, and a fixing unit 20.

The casing 11 is the body of the image forming apparatus 1. The casing 11 accommodates the communication interface 12, the system controller 13, the display unit 14, the operation interface 15, the plurality of sheet trays 16, the discharge tray 17, the conveyance unit 18, the image forming unit 19, and the fixing unit 20.

The communication interface 12 is an interface used to communicate with another device. The communication interface 12 is used to communicate with, for example, a host device (an external device). The communication interface 12 is configured by, for example, a LAN connector or the like. The communication interface 12 may perform wireless communication with another device in conformity with a standard such as Bluetooth (registered trademark) or Wi-Fi (registered trademark).

The system controller 13 controls the image forming apparatus 1. The system controller 13 includes, for example, a processor 21 and a memory 22.

The processor 21 is an arithmetic operation element that performs an arithmetic process. The processor 21 is, for example, a CPU. The processor 21 performs various processes based on data such as a program stored in the memory 22. The processor 21 functions as a control unit capable of performing various operations by executing the program stored in the memory 22.

The memory 22 is a storage medium that stores a program and data or the like used for the program. The memory 22 also functions as a working memory. That is, the memory 22 temporarily stores data which is being processed by the processor 21 and a program or the like executed by the processor 21.

The processor 21 performs various kinds of information processing by executing a program stored in the memory 22. For example, the processor 21 generates a printing job based on an image acquired from an external device via, for example, the communication interface 12. The processor 21 stores the generated printing job in the memory 22.

The printing job includes image data indicating an image which is formed on a printing medium P. The image data may be data for forming an image on one printing medium P or may be data for forming an image on a plurality of printing media P. Further, the printing job includes information indicating color printing or monochrome printing.

The processor 21 functions as a controller (an engine controller) that controls operations of the conveyance unit 18, the image forming unit 19, and the fixing unit 20 by executing a program stored in the memory 22. That is, the processor 21 controls conveying of the printing medium P by the conveyance unit 18, controls forming of an image on the printing medium P by the image forming unit 19, and controls fixing of an image on the printing medium P by the fixing unit 20.

The image forming apparatus 1 may include an engine controller apart from the system controller 13. In this case, the engine controller controls conveying of the printing medium P by the conveyance unit 18, controls forming of an image on the printing medium P by the image forming unit 19, and controls fixing of an image on the printing medium P by the fixing unit 20. In this case, the system controller 13 supplies information necessary for control in the engine controller to the engine controller.

The display unit 14 includes a display that displays a screen in accordance with a video signal input from a display control unit such as a graphic controller (not illustrated) or the system controller 13. For example, a screen for various settings of the image forming apparatus 1 and information such as a remaining toner amount are displayed on the display of the display unit 14.

The operation interface 15 is connected to an operation member (not illustrated). The operation interface 15 supplies an operation signal in response to an operation of the operation member to the system controller 13. The operation member is, for example, a touch sensor, a numeric key, a power key, a sheet feeding key, various function keys, or a keyboard. The touch sensor acquires information indicating a position designated in a certain region. When the touch sensor is configured as a touch panel integrated with the display unit 14, a signal indicating a position touched on a screen displayed on the display unit 14 is input to the system controller 13.

The plurality of sheet trays 16 are cassettes that accommodate the printing media P. The sheet tray 16 can supply the printing medium P from the outside of the casing 11. For example, the sheet tray 16 can be taken out from the casing 11.

The discharge tray 17 is a tray that supports the printing medium P discharged from the image forming apparatus 1.

Next, a configuration of the image forming apparatus 1 in which the printing media P is conveyed will be described.

The conveyance unit 18 is a mechanism that conveys the printing medium P in the image forming apparatus 1. As illustrated in FIG. 1, the conveyance unit 18 includes a plurality of conveyance paths. For example, the conveyance unit 18 includes a paper feed conveyance path 31 and a paper discharge conveyance path 32.

The paper feed conveyance path 31 and the paper discharge conveyance path 32 each include a plurality of motors, a plurality of rollers, and a plurality of guides (none of which are illustrated). The plurality of motors rotate the rollers synchronized with rotation of shafts by rotating the shafts under the control of the system controller 13. The plurality of rollers are rotated to move the printing medium P. The plurality of guides control a conveyance direction of the printing medium P.

The paper feed conveyance path 31 takes the printing medium P from the sheet tray 16 and supplies the taken printing medium P to the image forming unit 19. The paper feed conveyance path 31 includes a pickup roller 33 corresponding to each sheet tray. Each pickup roller 33 takes the printing medium P of each sheet tray 16 into the paper feed conveyance path 31.

The paper discharge conveyance path 32 is a conveyance path along which the printing medium P on which an image is formed is discharged from the casing 11. The printing medium P discharged by the paper discharge conveyance path 32 is supported by the discharge tray 17.

Next, the image forming unit 19 will be described.

The image forming unit 19 forms an image on the printing medium P. Specifically, the image forming unit 19 forms an image on the printing medium P based on a printing job generated by the processor 21.

The image forming unit 19 includes a plurality of load units 41, a plurality of process units 42, a plurality of exposure units 43, and a plurality of transfer mechanisms 44. The image forming unit 19 includes the load unit 41 and the exposure unit 43 for each process unit 42. Since the plurality of process units 42, the plurality of load units 41, and the plurality of exposure units 43 each have the same configurations, one process unit 42, one load unit 41, and one exposure unit 43 will be described as examples.

Figure 2:
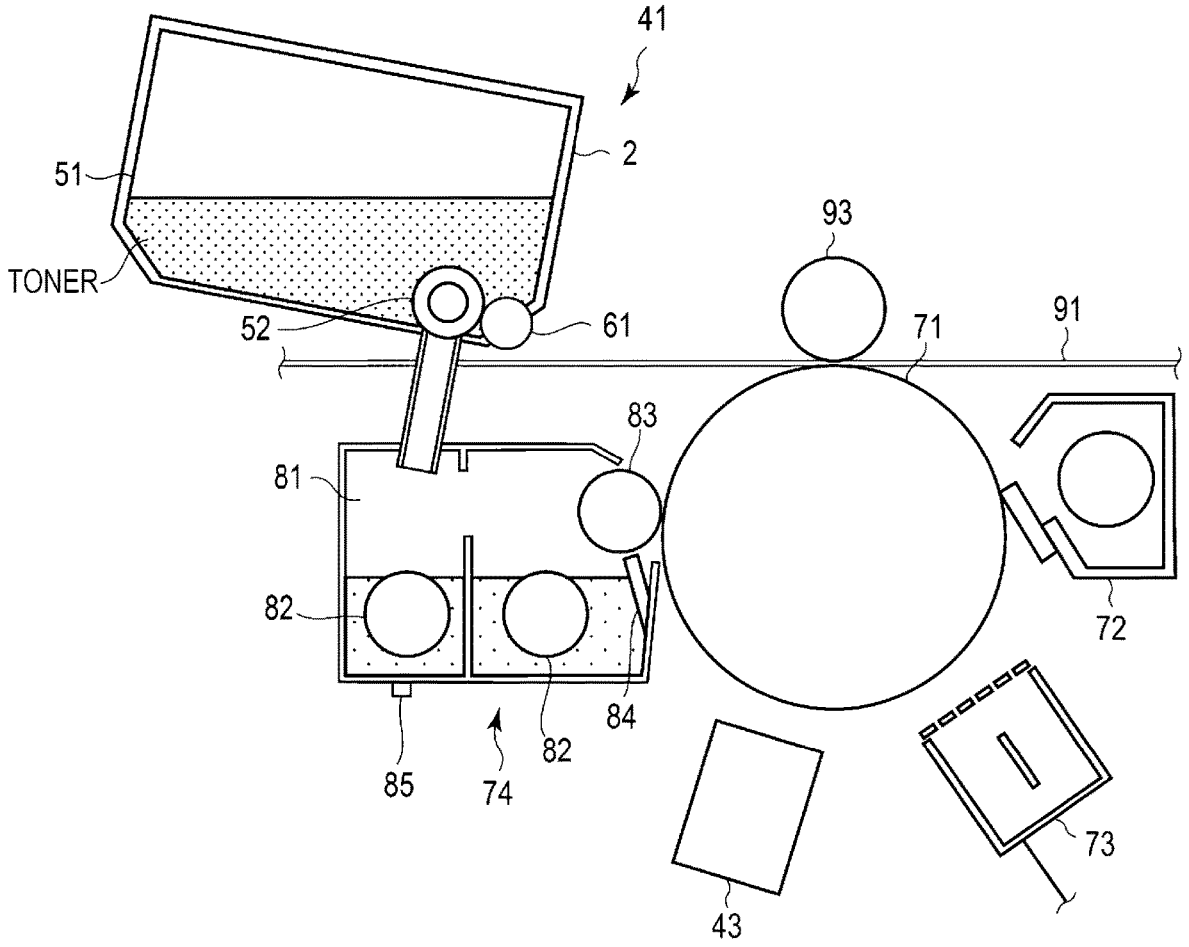
FIG. 2 is a diagram illustrating a configuration example of a part of an image forming unit.

FIG. 2 is a diagram illustrating a configuration example of a part of the image forming unit 19.

First, the toner cartridge 2 mounted on the load unit 41 will be described.

As illustrated in FIG. 2, the toner cartridge 2 includes a toner accommodation container 51 and a toner sending mechanism 52. The toner cartridge 2 includes an IC chip (not illustrated).

The toner accommodation container 51 is a container that accommodates toner.

The toner sending mechanism 52 is a mechanism that sends toner in the toner accommodation container 51. The toner sending mechanism 52 is, for example, a screw that is provided in the toner accommodation container 51 and is rotated to send the toner.

The IC chip includes a memory that stores various kinds of control data in advance. The control data is, for example, an "identification code" and a "near empty threshold." The "identification code" indicates a type and a model number of the toner cartridge 2. The "near empty threshold" is a threshold used for the image forming apparatus 1 to determine whether a remaining toner amount in the toner cartridge 2 is small.

Next, the load unit 41 on which the toner cartridge 2 is mounted will be described.

As illustrated in FIG. 2, the load unit 41 is a module on which the toner cartridge 2 filled with each toner is mounted. Each of the plurality of load units 41 includes a space in which the toner cartridge 2 is mounted and the toner supply motor 61. Each of the plurality of load units 41 includes a communication interface (not illustrated) that connects an IC chip of the toner cartridge 2 to the system controller 13.

The toner supply motor 61 drives the toner sending mechanism 52 of the toner cartridge 2 under the control of the processor 21. The toner supply motor 61 is connected to the toner sending mechanism 52 of the toner cartridge 2 when the toner cartridge 2 is loaded on the load unit 41. The toner supply motor 61 is electrified under the control of the processor 21 and rotates a shaft to drive the toner sending mechanism 52 of the toner cartridge 2. The toner supply motor 61 supplies the toner in the toner accommodation container 51 to a development unit to be described below by driving the toner sending mechanism 52.

Next, the process unit 42 will be described.

The process unit 42 is configured to form a toner image. For example, the plurality of process units 42 are provided for each kind of toner. For example, the plurality of process units 42 correspond to color toner of cyan, magenta, yellow, and black, respectively. Specifically, the toner cartridge 2 that has different color toner is connected to each process unit 42.

As illustrated in FIG. 2, the process unit 42 includes a photosensitive drum 71, a cleaner 72, an electrostatic charger 73, and a development unit 74.

The photosensitive drum 71 is a photoreceptor that has a cylindrical drum and a photosensitive layer formed on the outer circumferential surface of the drum. The photosensitive drum 71 is rotated at a constant speed by a driving mechanism (not illustrated).

The cleaner 72 removes toner remaining on the surface of the photosensitive drum 71.

The electrostatic charger 73 uniformly charges the surface of the photosensitive drum 71. For example, the electrostatic charger 73 charges the photosensitive drum 71 with a uniform negative potential by applying a voltage to the photosensitive drum 71 using a charging roller. The charging roller is rotated with rotation of the photosensitive drum 71 in a state in which the charging roller adds a predetermined pressure to the photosensitive drum 71.

The development unit 74 is a device that attaches the toner to the photosensitive drum 71. The development unit 74 includes a developer container 81, a stirring mechanism 82, a development roller 83, a doctor blade 84, and an auto toner control (ATC) sensor 85.

The developer container 81 is a container that accommodates developer including toner and carriers. The developer container 81 receives the toner sent from the toner cartridge 2 by the toner sending mechanism 52. The carriers are accommodated in the developer container 81 when the development unit 74 is manufactured.

The stirring mechanism 82 is driven by a motor (not illustrated) and stirs the toner and the carriers in the developer container 81.

The development roller 83 is rotated in the developer container 81 to attach the developer to the surface.

The doctor blade 84 is a member that is disposed to be away from the surface of the development roller 83 at a predetermined interval. The doctor blade 84 removes a part of the developer attached to the surface of the rotating development roller 83. Thus, a layer of the developer with a thickness in accordance with the interval between the doctor blade 84 and the surface of the development roller 83 is formed on the surface of the development roller 83.

The ATC sensor 85 is, for example, a magnetic flux sensor that includes, for example, a coil and detects a voltage value generated in the coil. A voltage detected by the ATC sensor 85 is changed by density of a magnetic flux from the toner in the developer container 81. That is, the system controller 13 can determine a density ratio of the toner remaining in the developer container 81 to the carriers based on the voltage detected by the ATC sensor 85.

Next, the exposure unit 43 will be described.

The exposure unit 43 includes a plurality of light-emitting elements. The exposure unit 43 forms a latent image on the photosensitive drum 71 by radiating light from the light-emitting elements to the charged photosensitive drum 71. The light-emitting element is, for example, a light-emitting diode (LED) or a laser diode (LD). One light-emitting element is configured to radiate light at one point on the photosensitive drum 71. The plurality of light-emitting elements are arranged in a main scanning direction which is a direction parallel to the rotation axis of the photosensitive drum 71.

The exposure unit 43 forms a latent image corresponding to one line on the photosensitive drum 71 by causing the plurality of light-emitting elements arranged in the main scanning direction to radiate light onto the photosensitive drum 71. Further, the exposure unit 43 forms a latent image of a plurality of lines by continuously radiating light onto the rotating photosensitive drum 71.

In the foregoing configuration, an electrostatic latent image is formed when the light is radiated from the exposure unit 43 to the surface of the photosensitive drum 71 charged by the electrostatic charger 73. When the layer of the developer formed on the surface of the development roller 83 approaches the surface of the photosensitive drum 71, the toner contained in the developer is attached to the latent image formed on the surface of the photosensitive drum 71. In this way, a toner image is formed on the surface of the photosensitive drum 71.

Next, the transfer mechanism 44 will be described.

The transfer mechanism 44 transfers the toner image formed on the surface of the photosensitive drum 71 to the printing medium P.

As illustrated in FIGS. 1 and 2, the transfer mechanism 44 includes, for example, a primary transfer belt 91, a secondary transfer counter roller 92, a plurality of primary transfer rollers 93, and a secondary transfer roller 94.

The primary transfer belt 91 is an endless belt that is wound around the secondary transfer counter roller 92 and a plurality of winding rollers. An inner surface (an inner circumferential surface) of the primary transfer belt 91 comes into contact with the secondary transfer counter roller 92 and the plurality of winding rollers and an outer surface (an outer circumferential surface) thereof faces the photosensitive drum 71 of the process unit 42.

The secondary transfer counter roller 92 is rotated by a motor (not illustrated). The secondary transfer counter roller 92 is rotated to convey the primary transfer belt 91 in a predetermined conveyance direction. The plurality of winding rollers are rotatable freely. The plurality of winding rollers are rotated with movement of the primary transfer belt 91 by the secondary transfer counter roller 92.

The plurality of primary transfer rollers 93 bring the primary transfer belt 91 into contact with the photosensitive drum 71 of the process unit 42. The plurality of primary transfer rollers 93 are provided to correspond to the photosensitive drums 71 of the plurality of process units 42. Specifically, the plurality of primary transfer rollers 93 are provided at positions facing the corresponding photosensitive drums 71 of the process units 42 with the primary transfer belt 91 interposed therebetween. The primary transfer rollers 93 come into contact with the inner circumferential surface of the primary transfer belt 91 to displace the primary transfer belt 91 to the sides of the photosensitive drums 71. Thus, the primary transfer rollers 93 bring the outer circumferential surface of the primary transfer belt 91 into contact with the photosensitive drums 71.

The secondary transfer roller 94 is provided at a position facing the primary transfer belt 91. The secondary transfer roller 94 comes into contact with the outer circumferential surface of the primary transfer belt 91 and adds a pressure. Thus, a transfer nip in which the secondary transfer roller 94 comes into close contact with the outer circumferential surface of the primary transfer belt 91 is formed. The secondary transfer roller 94 presses the printing medium P passing through the transfer nip against the outer circumferential surface of the primary transfer belt 91 when the printing medium P passes through the transfer nip.

The secondary transfer roller 94 and the secondary transfer counter roller 92 are rotated to convey the printing medium P supplied from the paper feed conveyance path 31 in a state in which the printing medium P is interposed therebetween. Thus, the printing medium P passes through the transfer nip.

In the foregoing configuration, when the outer circumferential surface of the primary transfer belt 91 comes into contact with the photosensitive drum 71, a toner image formed on the surface of the photosensitive drum is transferred to the outer circumferential surface of the primary transfer belt 91. As illustrated in FIG. 1, when the image forming unit 19 includes the plurality of process units 42, the primary transfer belt 91 receives the toner images from the photosensitive drums 71 of the plurality of process units 42. The toner images transferred to the outer circumferential surface of the primary transfer belt 91 are conveyed to the transfer nip in which the secondary transfer roller 94 comes into close contact with the primary transfer belt 91 by the primary transfer belt 91. When the printing medium P is in the transfer nip, the toner images transferred to the outer circumferential surface of the primary transfer belt 91 are transferred to the printing medium P in the transfer nip.

Next, a configuration related to fixing in the image forming apparatus 1 will be described.

The fixing unit 20 fixes a toner image by melting the toner transferred to the printing medium P. The fixing unit 20 operates under the control of the system controller 13. The fixing unit 20 includes a heating member that heats the printing medium P and a pressurization member that pressurizes the printing medium P. For example, the heating member is a heat roller 95. For example, the pressurization member is a press roller 96.

The heat roller 95 is a fixing rotator that is rotated by a motor (not illustrated). The heat roller 95 includes a core that is hollow and is formed of a metal and an elastic layer that is formed on the outer circumference of the core. The heat roller 95 is heated at a high temperature by a heater disposed on the inner side of the hollow core. The heater is, for example, a halogen heater. The heater may be an induction heating (IH) heater that heats the core by electromagnetic induction.

The press roller 96 is provided at a position facing the heat roller 95. The press roller 96 includes a core that has a predetermined outer diameter and is formed of a metal and an elastic layer that is formed on the outer circumference of the core. The press roller 96 applies a pressure to the heat roller 95 in accordance with stress added from a tension member (not illustrated). When the pressure is applied from the press roller 96 to the heat roller 95, a nip (a fixing nip) in which the press roller 96 comes into close contact with the heat roller 95 is formed. The press roller 96 is rotated by a motor (not illustrated). The press roller 96 is rotated to move the printing medium P entering the fixing nip and press the printing medium P against the heat roller 95.

In the foregoing configuration, the heat roller 95 and the press roller 96 apply heat and pressure to the printing medium P passing through the fixing nip. Thus, the toner image is fixed to the printing medium P passing through the fixing nip. The printing medium P passing through the fixing nip is introduced into the paper discharge conveyance path 32 to be discharged to the outside of the casing 11. The fixing unit 20 is not limited to the foregoing configuration. The fixing unit 20 may be configured in conformity with an on-demand scheme of giving heat to the printing medium P to which a toner image is transferred via a film-like member to melt and fix the toner.

Next, control of the image forming apparatus 1 by the system controller 13 will be described.

First, supply of the toner from the toner cartridge 2 will be described.

The processor 21 of the system controller 13 calculates a density ratio of toner to carriers (toner density ratio) in the developer in the developer container 81 of the development unit 74 based on a detection result of the ATC sensor 85 of the process unit 42. When the toner density ratio is less than a preset threshold (a toner supply threshold), the processor 21 drives the toner supply motor 61. Thus, the processor 21 drives the toner sending mechanism 52 of the toner cartridge 2 and supplies the toner in the toner accommodation container 51 to the developer container 81 of the development unit 74. For example, when it is detected that the toner density ratio is less than the toner supply threshold, the processor 21 drives the toner supply motor 61 for a preset time. When it is detected that the toner density ratio is less than the toner supply threshold, the processor 21 may drive the toner supply motor 61 until the toner density ratio becomes equal to or greater than the toner supply threshold.

The processor 21 detects toner emptiness indicating that the toner in the toner accommodation container 51 of the toner cartridge 2 is empty based on the toner density ratio at the time of driving the toner supply motor 61. For example, when the toner density ratio is not equal to or greater than the toner supply threshold despite driving the toner supply motor 61, the processor 21 detects the toner emptiness.

Next, a process of calculating a remaining toner amount in the toner accommodation container 51 of the toner cartridge 2 will be described.

Figure 3:
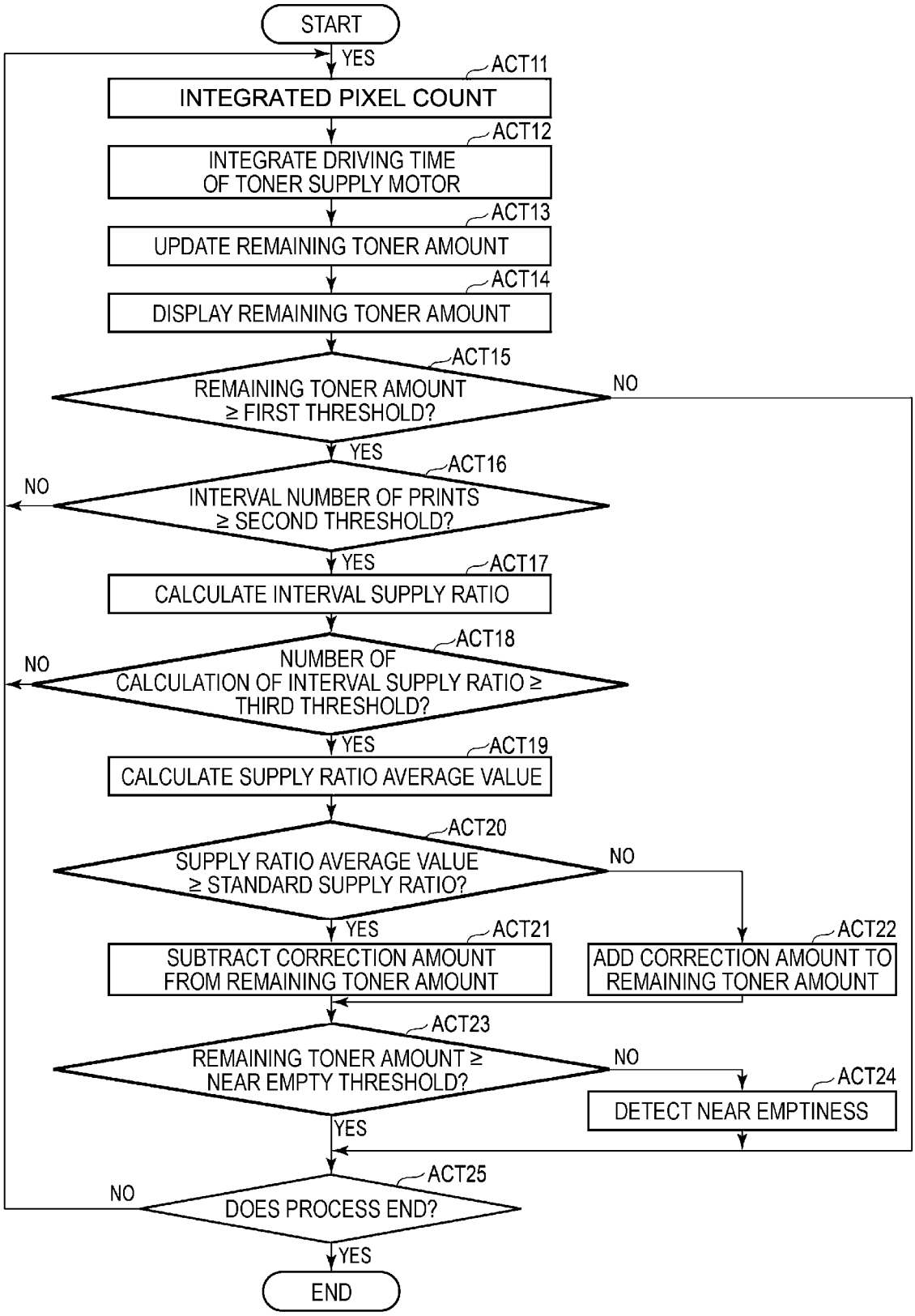
FIG. 3 is a diagram illustrating an example of an operation of the image forming apparatus.

FIG. 3 is a flowchart illustrating a process of calculating a remaining toner amount.

The processor 21 integrates a pixel amount (a pixel count value) based on a pixel value of printing image data (ACT11). For example, the processor 21 integrates the pixel count value based on the pixel value of the printing image data. Specifically, the processor 21 converts the image data into an image signal for driving each exposure unit 43. The processor 21 integrates the pixel count value for each color of the toner based on the image signal after the toner cartridge 2 is replaced. The processor 21 stores the pixel count value in, for example, the memory 22. The processor 21 updates the pixel count value on the memory 22 by integrating the pixel count value.

The processor 21 integrates a driving amount (a driving time) of the toner supply motor 61 after the toner cartridge 2 is replaced (ACT12). For example, the processor 21 stores the driving time in the memory 22. The processor 21 updates the driving time on the memory 22 by integrating the driving time.

The processor 21 updates the remaining toner amount indicating a remaining amount of toner in the toner accommodation container 51 of the toner cartridge 2 (ACT13). For example, the processor 21 stores the remaining toner amount in the memory 22. For example, the processor 21 updates the remaining toner amount on the memory 22 based on either the integrated value of the pixel count value or the integrated value of the driving time.

For example, the processor 21 calculates a toner supply amount based on either the integrated value of the pixel count value or the integrated value of the driving time. The toner supply amount is a ratio of the amount of toner supplied from the toner cartridge 2 to the development unit 74 to an initial value of the amount of toner in the toner accommodation container 51 of the toner cartridge 2. An initial value of the remaining toner amount on the memory 22 is 100 [%]. The processor 21 updates the remaining toner amount [%] on the memory 22 based on the calculated toner supply amount [%] and the remaining toner amount [%] on the memory 22.

First, an example in which the toner supply amount is calculated based on the driving time will be described.

The processor 21 calculates a rotation amount based on the number of rotations (a rotation amount) of the shaft of the toner supply motor 61 per driving time and an increment of the integrated value of the driving time after the updating of a previous remaining toner amount. The processor 21 calculates a toner supply amount [%] in accordance with the increment of the integrated value of the driving time based on the rotation amount and the toner supply amount per rotation amount. The processor 21 updates the remaining toner amount [%] on the memory 22 by subtracting the calculated toner supply amount [%] from the remaining toner amount [%] on the memory 22.

The rotation number (the rotation amount) of the shaft of the toner supply motor 61 per driving time and the toner supply amount per rotation amount are determined in advance in consideration of an average value of evaluation results for each model of the image forming apparatus 1 and the toner cartridge 2, a variation in the image forming apparatus 1, and the like.

Next, an example in which a toner supply amount is calculated based on the pixel count value will be described.

The processor 21 calculates a toner supply amount [%] in accordance with an increment of the integrated value of the pixel count value based on the toner supply amount per pixel count value and an increment of the integrated value of the pixel count value after the updating of a previous remaining toner amount. The processor 21 updates the remaining toner amount [%] on the memory 22 by subtracting the calculated toner supply amount [%] from the remaining toner amount [%] on the memory 22.

The toner supply amount per pixel count value is determined in advance in consideration of an average value of evaluation results for each model of the image forming apparatus 1 and the toner cartridge 2, a variation in the image forming apparatus 1, and the like.

The processor 21 causes the display unit 14 to display the remaining toner amount on the memory 22 (ACT14). The processor 21 may cause the display unit 14 to display the remaining toner amount in accordance with an input operation or may notify another device of the remaining toner amount via the communication interface 12.

Figure 4:
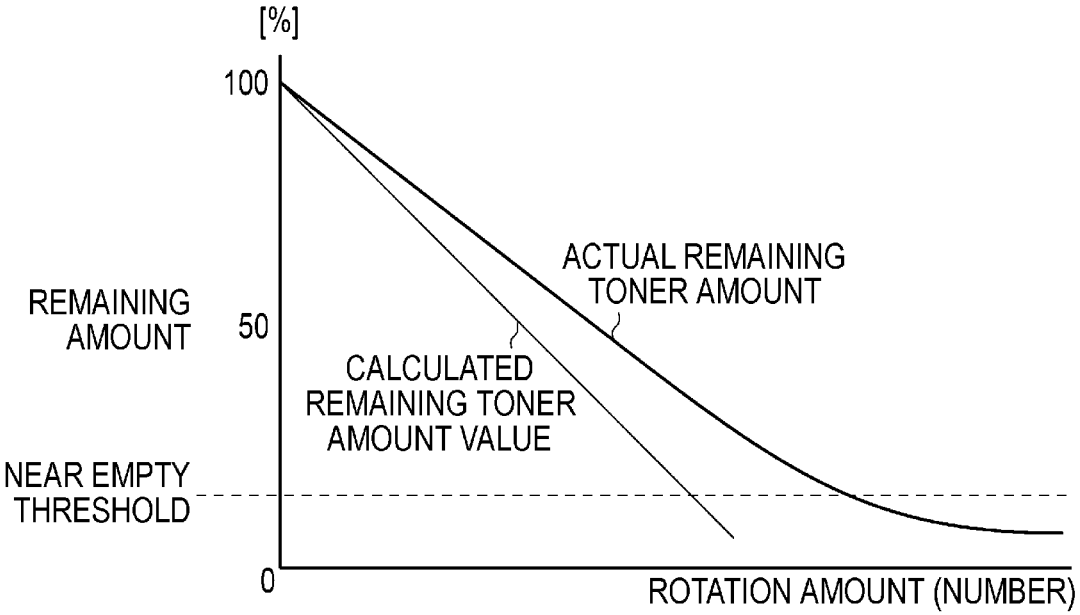
FIG. 4 is a diagram illustrating an example of an operation of the image forming apparatus.

FIG. 4 is a diagram illustrating an example of a relation between a calculated value of the remaining toner amount (calculated remaining toner amount value) and an actual remaining toner amount (actual remaining toner amount). The horizontal axis of FIG. 4 represents a rotation amount (that is, an integrated value of the driving time). The vertical axis of FIG. 4 represents a remaining toner amount.

As illustrated in FIG. 4, there is a possibility of a deviation occurring between the calculated remaining toner amount value and the actual remaining toner amount due to a variation in the individual toner cartridge 2. For example, since a load of the toner sending mechanism 52 of the toner cartridge 2 differs from an assumed load, there is a possibility of a toner supply amount per driving time varying.

Accordingly, the processor 21 performs a remaining toner amount correction process to be described below. In the remaining toner amount correction process, the processor 21 calculates a toner supply ratio by dividing a normalized value of the integrated value of the pixel count value by a normalized value of the integrated value of the driving time of the toner supply motor 61. The processor 21 corrects the remaining toner amount based on the toner supply ratio and a preset standard supply ratio.

Hereinafter, the remaining toner amount correction process will be described.

The processor 21 determines whether the remaining toner amount on the memory 22 is equal to or greater than a preset first threshold (ACT15). When the processor 21 determines that the remaining toner amount on the memory 22 is less than the preset first threshold (NO in ACT15), the process proceeds to ACT25 to be described below. Thus, when the processor 21 determines that the remaining toner amount on the memory 22 is less than the preset first threshold, the processor 21 performs control such that the remaining toner amount correction process is not performed.

When the processor 21 determines that the remaining toner amount on the memory 22 is equal to or greater than the preset first threshold (YES in ACT15), the processor 21 determines whether the interval number of prints is equal to or greater than a preset second threshold (ACT16). The interval number of prints indicates the number of printed documents. The processor 21 resets the interval number of prints whenever the interval number of prints becomes equal to or greater than the second threshold. When the processor 21 determines that the interval number of prints is less than the preset second threshold (NO in ACT16), the process proceeds to ACT11. That is, the processor 21 repeatedly performs the processes from ACT11 to ACT16 until the interval number of prints becomes equal to or greater than the preset second threshold. For example, the processor 21 performs the processes from ACT11 to ACT16 whenever a single print or a predetermined number of prints is performed.

When the processor 21 determines that the interval number of prints is equal to or greater than the preset second threshold (YES in ACT16), the processor 21 calculates an interval supply ratio which is a toner supply ratio during printing of the interval number of prints (ACT17). That is, the processor 21 calculates the interval supply ratio whenever the interval number of prints reaches the preset second threshold.

The interval supply ratio is a ratio of a toner usage amount to a toner supply amount while the interval number of prints is reset and reaches the second threshold (hereinafter simply referred to as a supply ratio calculation interval). The toner usage amount can be estimated from the pixel count value. The toner supply amount can be estimated from the driving time of the toner supply motor 61. The processor 21 calculates the interval supply ratio based on the integrated value of the pixel count value and the integrated value of the driving time of the toner supply motor 61. For example, the processor 21 calculates an interval supply ratio based on an increment of the integrated value of the pixel count value in the supply ratio calculation interval and an increment of the integrated value of the driving time of the toner supply motor 61 in the supply ratio calculation interval. More specifically, the processor 21 calculates a value obtained by dividing the normalized value of the increment of the integrated value of the pixel count value by the normalized value of the increment of the integrated value of the driving time of the toner supply motor 61 as the interval supply ratio.

The processor 21 determines whether the number of calculation of the interval supply ratio is equal to or greater than a preset third threshold (ACT18). The processor 21 counts up the number of calculation of the interval supply ratio whenever the interval supply ratio is calculated in ACT17. The processor 21 resets the count value of the number of calculation of the interval supply ratio whenever the number of calculation of the interval supply ratio becomes equal to or greater than the preset third threshold. When the processor 21 determines that the number of calculation of the interval supply ratio is equal to or less than the preset third threshold (NO in ACT18), the process proceeds to ACT11. That is, the processor 21 repeatedly performs the processes from ACT11 to ACT18 until the number of calculation of the interval supply ratio becomes equal to or greater than the preset third threshold.

When the processor 21 determines that the number of calculation of the interval supply ratio is greater than or equal to the preset third threshold (YES in ACT18), the processor 21 calculates a supply ratio average value (ACT19). The supply ratio average value is an average value of a plurality of interval supply ratios calculated by repeating the processes from ACT11 to ACT18. The processor 21 may calculate a central tendency such as a median value of the plurality of interval supply ratios.

The processor 21 determines whether the calculated supply ratio average value is equal to or greater than a preset standard supply ratio (ACT20). That is, the processor 21 calculates a difference between the calculated supply ratio average value and the standard supply ratio and determines whether the difference is positive or negative. The standard supply ratio is determined in advance in consideration of an average value of evaluation results for each model of the image forming apparatus 1 and the toner cartridge 2, a variation in the image forming apparatus 1, and the like.

When the processor 21 determines that the calculated supply ratio average value is equal to or greater than a preset standard supply ratio (YES in ACT20), the processor 21 subtracts a preset correction amount [%] from the remaining toner amount on the memory 22 updated in ACT13 (ACT21), and then the process proceeds to ACT23. When the calculated supply ratio average value is equal to or greater than the preset standard supply ratio, a toner supply amount per driving time or pixel count value is estimated to be greater than a standard. Therefore, the processor 21 can make the calculated value of the remaining toner amount close to the actual remaining toner amount by subtracting the correction amount from the calculated remaining toner amount.

When the processor 21 determines that the calculated supply ratio average value is less than the preset standard supply ratio (NO in ACT20), the processor 21 adds the preset correction amount [%] to the remaining toner amount on the memory 22 updated in ACT13 (ACT22) and the process proceeds to ACT23. When the calculated supply ratio average value is less than the preset standard supply ratio, the toner supply amount per driving time or pixel count value is estimated to be less than a standard. Therefore, the processor 21 can make the calculated value of the remaining toner amount close to the actual remaining toner amount by adding the correction amount to the calculated remaining toner amount.

Figure 5:
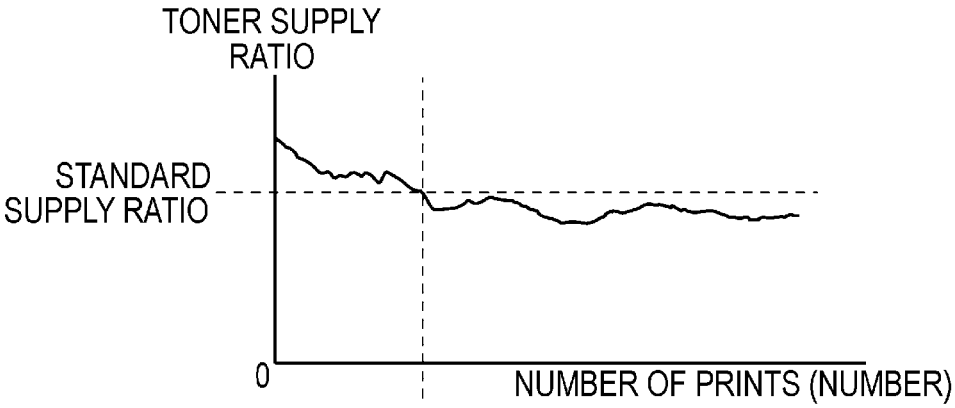
FIG. 5 is a diagram illustrating an example of an operation of the image forming apparatus.

FIG. 5 is a diagram illustrating an example of a relation between the toner supply ratio and the standard supply ratio. The horizontal axis of FIG. 5 represents the number of prints. The vertical axis of FIG. 5 represents a toner supply ratio. As illustrated in FIG. 5, there is a possibility of the toner supply ratio varying. However, as described above, by calculating an average value of a plurality of interval supply ratios and comparing the average value with the standard supply ratio, it is possible to prevent a magnitude relation between the supply ratio average value and the standard supply ratio from frequently switching.

The processor 21 may determine the correction amount in ACT21 and ACT22 based on an absolute value of a difference between the supply ratio average value and the standard supply ratio.

Subsequently, the processor 21 determines whether the corrected remaining toner amount is equal to or greater than a preset near empty threshold (ACT23). When the processor 21 determines that the corrected remaining toner amount is equal to or greater than the preset near empty threshold (YES in ACT23), the process proceeds to ACT25. When the processor 21 determines that the corrected remaining toner amount is less than the preset near empty threshold (NO in ACT23), the processor 21 detects a near empty state (ACT24), and then the process proceeds to ACT25. The near empty state indicates a state in which the toner in the toner cartridge 2 is small. When the near empty state is detected, the processor 21 causes the display unit 14 to output information prompting preparation to replace the toner cartridge (display toner near emptiness).

The processor 21 determines whether the process ends (ACT25). For example, when an operation of ending the operation of the image forming apparatus 1 is performed or the toner emptiness is detected, the processor 21 determines that the process ends. When the processor 21 determines that the process does not end (NO in ACT25), the process proceeds to ACT11. Thus, the processor 21 repeatedly performs the processes from ACT11 to ACT25 to calculate and correct the remaining toner amount in sequence. When the processor 21 determines that the process ends (YES in ACT25), the processor 21 ends the process of FIG. 3.

Figure 6:
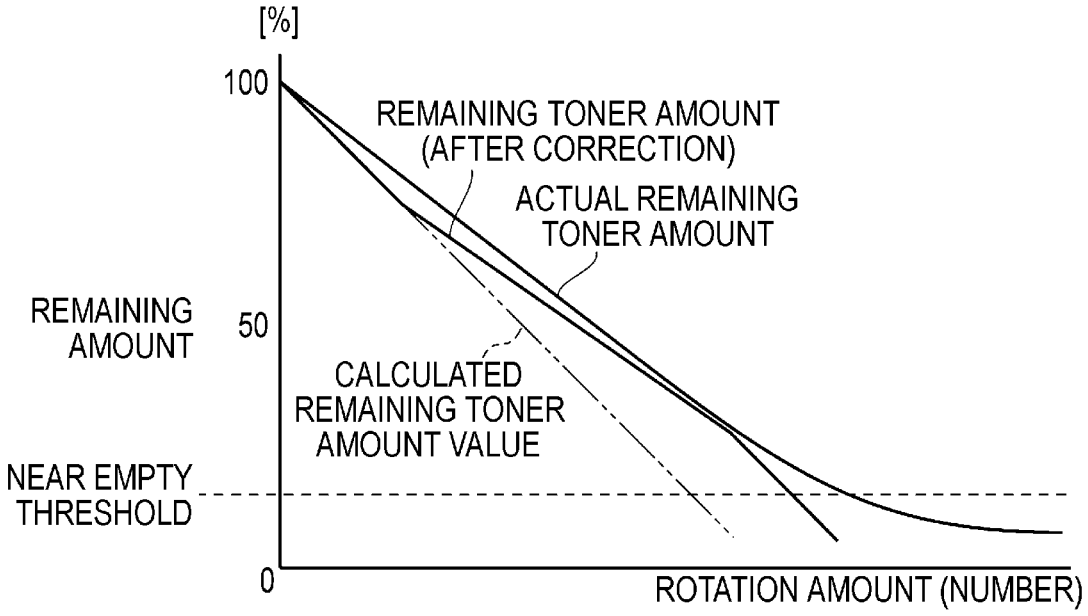
FIG. 6 is a diagram illustrating an example of an operation of the image forming apparatus.

FIG. 6 is a diagram illustrating an example of a relation between a corrected remaining toner amount and an actual remaining toner amount. The horizontal axis of FIG. 6 represents a rotation amount (that is, an integrated value of the driving time). The vertical axis of FIG. 6 represents a remaining toner amount.

FIG. 6 illustrates an example in which the supply ratio average value is less than the standard supply ratio. In this example, when the calculated remaining toner amount value is not corrected, a deviation between the actual remaining toner amount and the calculated remaining toner amount value increases with an increase in the rotation amount. However, as described above, the processor 21 adds the correction amount to the calculated remaining toner amount value based on a comparison result between the supply ratio average value and the standard supply ratio. As a result, the corrected remaining toner amount can be made close to the actual remaining toner amount.

As described above, the image forming apparatus 1 includes the photosensitive drum 71, the exposure unit 43, the development unit 74, the toner supply motor 61, and the processor 21. The processor 21 calculates the remaining toner amount based on the integrated value of the driving time of the toner supply motor 61 supplying the toner from the toner cartridge 2 to the development unit 74. Further, the processor 21 calculates the toner supply ratio based on the integrated value of the pixel count value of the printing image data and the integrated value of the driving time of the toner supply motor 61. The processor 21 corrects the remaining toner amount based on the preset standard supply ratio and the toner supply ratio.

Thus, even when a "correction amount" is not set for each toner cartridge 2, the processor 21 can make the corrected remaining toner amount close to the actual remaining toner amount. That is, the image forming apparatus 1 can correct a variation caused by an individual difference in the toner cartridge 2. As a result, it is possible to prevent the detection of the near empty state from considerably deviating from an actual remaining toner amount in the toner cartridge 2.

The functions described in each of the above-described embodiments can be realized not only using hardware but also using software by reading a program describing each function to a computer. Each function can be configured by appropriately selecting software or hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a photosensitive drum;

an exposure component configured to expose the photosensitive drum based on image data;

a development component configured to forma toner image on the photosensitive drum with toner supplied from a toner cartridge;

a toner supply motor configured to supply the toner to the development component from the toner cartridge; and a processor configured to calculate a remaining toner amount in the toner cartridge based on a preset standard supply ratio, a driving time of the toner supply motor, and a toner supply ratio which is calculated based on a pixel count value of the image data and the driving time of the toner supply motor.

2. The apparatus according to claim 1, wherein the processor calculates the remaining toner amount based on the driving time of the toner supply motor, and the processor corrects the remaining toner amount based on the preset standard supply ratio and the toner supply ratio.

3. The apparatus according to claim 2, wherein the processor subtracts a correction value from the remaining toner amount when the toner supply ratio is greater than the preset standard supply ratio.

4. The apparatus according to claim 3, wherein the processor determines the correction value based on a difference between the toner supply ratio and the preset standard supply ratio.

5. The apparatus according to claim 2, wherein the processor adds a correction value to the remaining toner amount when the toner supply ratio is less than the preset standard supply ratio.

6. The apparatus according to claim 5, wherein the processor determines the correction value based on a difference between the toner supply ratio and the preset standard supply ratio.

7. The apparatus according to claim 2, wherein the processor does not correct the remaining toner amount when the remaining toner amount is less than a preset threshold.

8. The apparatus according to claim 1, wherein the processor detects a near emptiness state when the remaining toner amount is less than a preset near empty threshold.

9. A method of operating an image forming apparatus including a photosensitive drum, an exposure component that exposes the photosensitive drum based on image data, a development component that forms a toner image on the photosensitive drum with toner supplied from a toner cartridge, a toner supply motor that supplies the toner to the development unit from the toner cartridge, the method comprising:

calculating a remaining toner amount in the toner cartridge based on a preset standard supply ratio, a driving time of the toner supply motor, and a toner supply ratio which is calculated based on a pixel count value of the image data and the driving time of the toner supply motor.

10. The method according to claim 9, further comprising:

calculating the remaining toner amount based on the driving time of the toner supply motor, and correcting the remaining toner amount based on the preset standard supply ratio and the toner supply ratio.

11. The method according to claim 10, further comprising:

subtracting a correction value from the remaining toner amount when the toner supply ratio is greater than the preset standard supply ratio.

12. The method according to claim 9, further comprising:

detecting a near emptiness state when the remaining toner amount is less than a preset near empty threshold.

13. An image forming apparatus, comprising:

a photosensitive drum;

an exposure component configured to expose the photosensitive drum based on image data;

a development component configured to forma toner image on the photosensitive drum with toner supplied from a toner cartridge;

a toner supply motor configured to supply the toner to the development component from the toner cartridge; and a processor configured to calculate a remaining toner amount in the toner cartridge based on a preset standard supply ratio, a pixel count value of the image data, and a toner supply ratio which is calculated based on the pixel count value and a driving time of the toner supply motor.

14. The apparatus according to claim 13, wherein the processor calculates the remaining toner amount based on the pixel count value, and the processor corrects the remaining toner amount based on the preset standard supply ratio and the toner supply ratio.

15. The apparatus according to claim 14, wherein the processor subtracts a correction value from the remaining toner amount when the toner supply ratio is greater than the preset standard supply ratio.

16. The apparatus according to claim 15, wherein the processor determines the correction value based on a difference between the toner supply ratio and the preset standard supply ratio.

17. The apparatus according to claim 14, wherein the processor adds a correction value to the remaining toner amount when the toner supply ratio is less than the preset standard supply ratio.

18. The apparatus according to claim 17, wherein the processor determines the correction value based on a difference between the toner supply ratio and the preset standard supply ratio.

19. The apparatus according to claim 14, wherein the processor does not correct the remaining toner amount when the remaining toner amount is less than a preset threshold.

20. The apparatus according to claim 13, wherein the processor detects near emptiness when the remaining toner amount is less than a preset near empty threshold.

* * * * *